United States Patent [19]

Potosnak et al.

[11] 3,987,519

[45] Oct. 26, 1976

[54] APPARATUS FOR CRUSHING CLOTH

[75] Inventors: Stephen J. Potosnak, Clifton; Carl J. Russo, Montvale, both of N.J.

[73] Assignee: J. P. Stevens & Co., Inc., New York, N.Y.

[22] Filed: Sept. 15, 1975

[21] Appl. No.: 613,386

[52] U.S. Cl. ..... 26/69 R; 26/1; 223/28; 226/158; 264/282

[51] Int. Cl.[2] ..... D06C 23/04; D06J 1/02

[58] Field of Search ..... 26/1, 69 R; 223/28, 223/29; 264/282; 226/158

[56] References Cited

UNITED STATES PATENTS

| | | | |
|---|---|---|---|
| 1,703,728 | 2/1929 | Ezbelent | 26/69 R UX |
| 1,978,407 | 10/1934 | Cadgene | 26/1 |
| 2,055,872 | 9/1936 | Manning | 226/158 X |
| 2,347,086 | 4/1944 | Curtiss et al. | 223/28 X |
| 2,851,206 | 9/1958 | Guenther et al. | 223/28 |
| 3,877,118 | 4/1975 | Misenheimer et al. | 26/69 R X |
| 3,925,863 | 12/1975 | Meyer | 26/1 |
| 3,939,536 | 2/1976 | Ruppe | 26/69 R X |

FOREIGN PATENTS OR APPLICATIONS

| | | | |
|---|---|---|---|
| 37-12046 | 8/1962 | Japan | 26/69 R |
| 45-28757 | 9/1970 | Japan | 26/1 |

*Primary Examiner*—Robert R. Mackey
*Attorney, Agent, or Firm*—Robert Ames Norton; Michael T. Frimer; Saul Leitner

[57] ABSTRACT

A cloth stuffing chamber or container, preferably a tube with entrance and exit portions, is provided with means for preventing backward movement of the cloth. This means is preferably in the form of a fixed ring at the beginning of the exit portion having around its inner surface at least several segments of wire which are slanted toward the exit portion of the tube. There is provided between the entrance and fixed ring a movable ring with wires or pins also slanting in the same exit direction, which ring is reciprocated by a drive, such as a cam and follower. Cloth is introduced into the entrance portion of the chamber and passes through the two rings, and as the movable ring reciprocates, its slanted wires move the cloth forward on the forward stroke and on the reverse stroke the slanted pins of the fixed ring prevent the cloth from moving backwards. This results in stuffing the cloth into the exit end of the chamber or tube, which crushes the cloth due to the friction of the inner wall of the exit end or any other means for applying a back pressure to the cloth. After stuffing, the crushed cloth may, if desired, be heat treated to set the crushed history, after which the cloth may be cooled and passed through a tenter frame and heated to stabilize the crushed, texturized appearance of the cloth.

9 Claims, 3 Drawing Figures

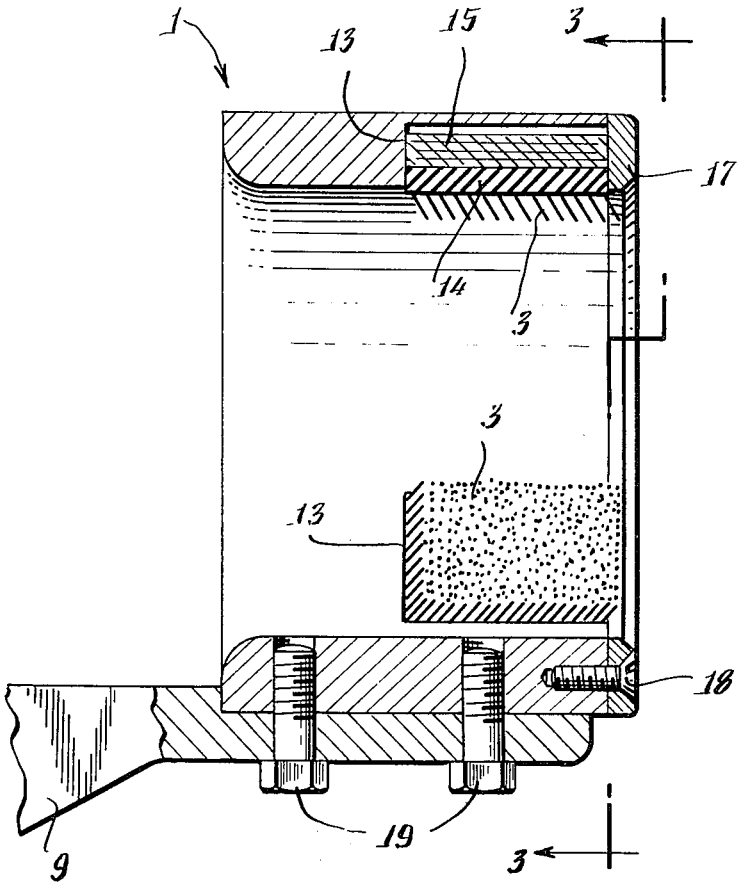
Fig. 2.
Fig. 3.
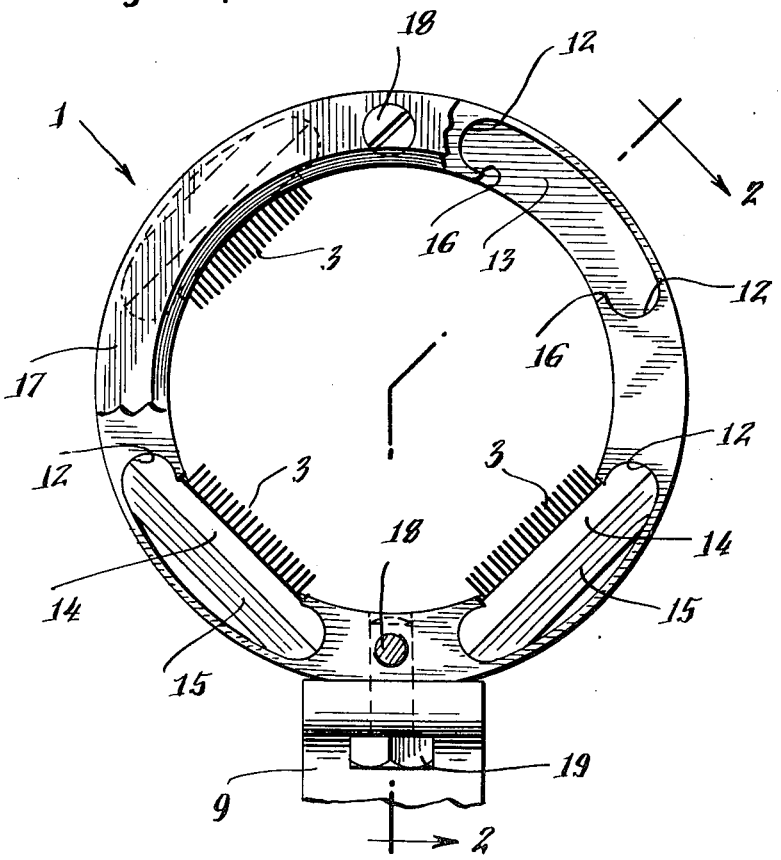

APPARATUS FOR CRUSHING CLOTH

BACKGROUND OF THE INVENTION

Crushed cloth which can have the crushed history set to give a texturized appearance, is a desirable form of fabric for certain uses. The setting of the crushed memory is normally effected by heat, such as steam, boiling water, hot air, and the like; and then, after cooling, the crushed cloth is stretched on a tenter frame and heat is applied to stabilize the texturized appearance. It is with an improved apparatus for crushing the cloth that the present invention deals.

SUMMARY OF THE INVENTION

A chamber, such as a tube, is provided into which cloth can be stuffed and therefore crushed. Near the exit end of the tube there is provided means for preventing backward motion of the cloth toward the entrance end of the tube. Such means include sharp wires or pins slanted toward the exit portion of the tube. The wires may project from at least portions of the inner periphery or surface and preferably from a ring affixed to the inner wall of the tube, just before the exit portion. The ring is provided with one or more segments carrying the slanted wires and, preferably, may include a beveled surface to guide cloth toward the slanted wires. Between the fixed ring with the wire segments and the entrance of the tube there is a second ring, of smaller diameter, with wires similarly oriented, which ring can be reciprocated, substantially along the axis of the tube.

When cloth is introduced through the two rings and reciprocation started, the reciprocating ring, on its forward stroke, moves the cloth forward until it passes the slanted pins of the fixed ring and on the rearward stroke of the reciprocating ring the slanted pins of the fixed ring prevent the cloth from moving backwards and the slanted pins on the reciprocating ring slide over the cloth. Each reciprocation therefore stuffs a further portion of cloth into the exit portion of the tube or chamber, resulting in crushing of the cloth.

After crushing, the cloth is preferably subjected to the heat treatments previously described which sets the texturized appearance of the final cloth. As has been stated, various forms of heat may be used, such as boiling water, steam, hot air, and the like. The heat treatments are not affected by the present invention and are therefore not described in detail.

The machine of the present invention crushes cloth continuously and rapidly, and with substantial uniformity, as the wires in the fixed ring do not permit the cloth to slide back out of the tube or chamber into which it is stuffed and crushed.

The present invention can be used with any desired cloth. It is preferable, although not essential, that the cloth have some heat setting characteristics. This applicability to various kinds of cloth adds to the versatility of the apparatus.

The drive of the reciprocating ring can be of any desired type, such as cam drive and the like. Although a reciprocating source is needed, the particular design of the reciprocating drive is not a distinguishing feature of the present invention and any suitable conventional reciprocating drive can be used. The reciprocating ring is maintained so that it reciprocates substantially along the same axis of both rings. One form of drive has the reciprocating ring on a bracket which reciprocates in a slot in the tube wall. This particular structure, however, is not a distinguishing feature of the invention and any other structure which maintains the alignment under oscillation may be used.

BRIEF DESCRIPTION OF THE DRAWINGS

FIG. 2 is a view partly in section of ring 1, along line 2—2 of FIG. 3, and FIG. 3 is a view partly in section along line 3—3 of FIG. 2 showing part of the structure of ring 1.

DESCRIPTION OF THE PREFERRED EMBODIMENT

Figure 1:
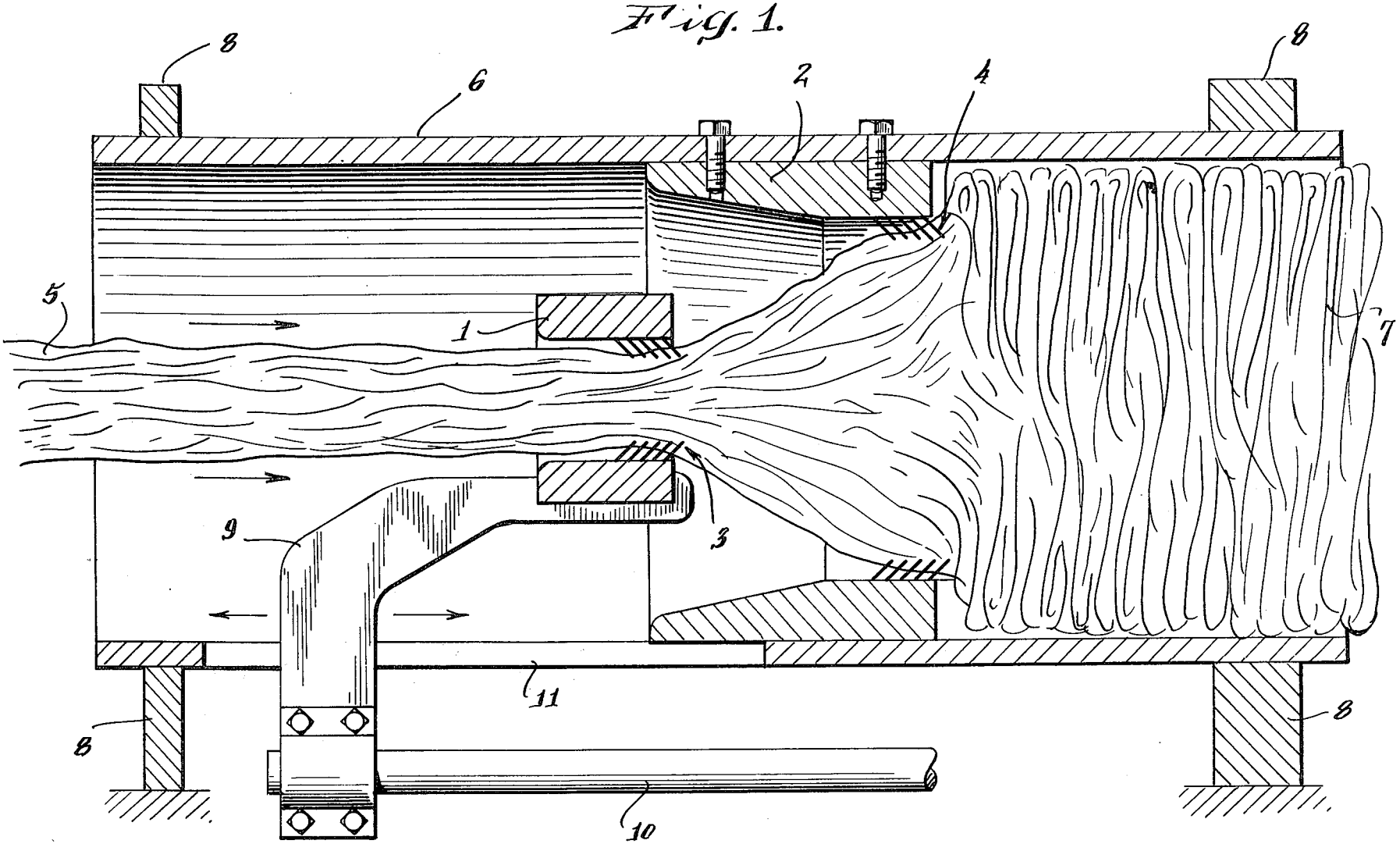
FIG. 1 is an elevation, partly in section, of the machine of the present invention.

A tube 6, the exit portion of which serves as a chamber into which cloth is stuffed and thus crushed, is supported on blocks 8, which are shown in section and are part of a machine frame.

In the tube 6, just before the exit end there is mounted a fixed ring 2 with slanting wires 4 which slant forwardly towards the exit and are sufficiently sharp to snag the cloth and prevent it from sliding backwards towards the entrance portion but which are sufficiently slanted so that the cloth can slide over them when moving towards the exit end.

In front of the fixed ring 2 there is provided a reciprocating ring 1 which is mounted in a bracket 9. This ring is also provided with slanted wires 3, preferably of the same form as those in the fixed ring 2. The bracket 9 can move in a slot 11 in the wall of the tube and is reciprocated by a rod 10 which connects to a reciprocating drive, (not shown). Any suitable oscillatory drive, such as a cam, may be used. The reciprocating ring 1 is preferably of smaller diameter than the fixed ring 2. This is shown partly in section in FIG. 1. Details of the segments of the reciprocating ring will be described below in conjunction with the description of FIGS. 2 and 3.

FIGS. 2 and 3, which are views partly in section, as designated above, and in which FIG. 3 shows a part of the structure of ring 1 broken away, illustrate a preferred form of the reciprocating ring 1. The ring itself and the wires bear the same numerals as in FIG. 1, as does the bracket 9. It will be seen that instead of having wires all the way around the inside of the ring as indicated on FIG. 1 they are preferably in four segments. This is best seen in FIG. 3, which shows one of the segments removed. In each segment the wires 3 are mounted in an elastic substrate 14 which is backed up by laminated fabric 15, making the whole somewhat flexible but stiff enough to snap into position when inserted. As can be seen, particularly in FIG. 3, there are four cavities which have elliptical shaped cavities 12 and which do not extend all the way to the other end of the ring, thus forming a shoulder 13 which, while visible in the case of one of the segments shown removed in FIG. 3, is brought out a little more clearly in FIG. 2. The elliptical shape of the side edges 12 does not extend all the way to the inner periphery of the ring, and there is thus provided a straight projecting shoulder 16 which retains the elastic substrate 14 sufficiently to hold it firmly. This is best seen in FIG. 3 where one segment is shown removed. The segments are inserted, and once inserted spring into the curved portions 12 of the ring and hold the wires with their double substrate firmly by a clamping ring 17 which is fastened to the oscillating ring 1 by two machine bolts 18. When these bolts are tightened, the segments are held firmly, locking them in place. The segment as a whole is somewhat springy, and is thus maintained in a firm position when clamped down by the ring 17. The arrangement of the wires in segments is preferred because there is an advantage in the fact that when the wires in a segment eventually become dulled or worn, it is a simple matter to unscrew the bolts 18, remove the ring 17, and insert new segments.

The larger circumference of pins on the stationary ring 2 may either be mounted all the way around the inner periphery or may also be in the form of segments, as has just been described for the reciprocating ring 1. The illustration in FIG. 1 is intended to be somewhat diagrammatic and shows the positioning of the pins in each ring and, of course, is equally illustrative of the construction whether it is in the form of segments or continuous. As the segments are mounted in the same manner as in ring 1, the details of the cavities are not repeated since, except for size, they do not differ substantially from those illustrated in FIGS. 2 and 3. These figures also illustrate the fastening of ring 1 to the bracket 9 by bolts 19.

To start the machine, a longitudinally folded rope 5 of cloth is passed through the ring 1, and the fixed ring 2 and the machine drive started. Reciprocation of the ring 1 stuffs successive bunches of cloth into the exit portion of the tube, where they expand and fold in random soft folds 7. It is this result which is known in the art as crushing the cloth. The crushed cloth may then be heat treated. The heat treating step or steps, which are conventional, are not illustrated as they are not changed by the present invention.

We claim:

1. A machine for the continuous crushing of cloth comprising, in combination, a. a tube having entrance and exit portions, the exit portion of which constitutes a chamber in which crushed cloth accumulates, b. A fixed surface provided near the exit portion of the tube, said surface having at least one portion provided with internal projections slanting toward the exit portion of the tube, c. A movable ring positioned in front of said fixed surface and beyond the entrance portion of the tube, said ring being provided with internal projections slanted towards said exit portion, and d. means for reciprocating said movable ring whereby when a rope of cloth is threaded through the movable ring and the fixed surface, and reciprocation of the movable ring is started, successive portions of the cloth are thereby stuffed through the movable ring and fixed surface into the exit portion of the tube, and backward motion of the cloth is prevented by the slanted projections in the fixed surface whereby the cloth is stuffed into the exit portion and crushed.

2. A machine according to claim 1 in which the fixed surface is a fixed ring and the projections are wires.

3. A machine according to claim 2 in which the slanted projections are in segments and the ring and surface are provided with cavities and detent means permitting snapping the segments into place.

4. A machine according to claim 2 in which the movable ring is mounted on a bracket, the tube is provided with a slot in which the bracket moves, and the reciprocating means moves the bracket.

5. A machine according to claim 2 in which the wires are in a plurality of segments in at least the reciprocating ring, which segments are mounted in recesses in the ring and a clamping ring secured to the movable, reciprocating ring to retain the segments therein.

6. A machine according to claim 1 in which the slanted projections are in segments and the movable ring and said surface are provided with cavities and detent means permitting snapping the segments into place.

7. A machine according to claim 6 in which the movable ring is mounted on a bracket, the tube is provided with a slot in which the bracket moves, and the reciprocating means moves the bracket.

8. A machine according to claim 6 in which the segments carrying the wires comprise an elastomer in which the wires are mounted and a stiff multiple laminate backing up the elastomer and wires.

9. A machine according to claim 1 in which the movable ring is mounted on a bracket, the tube is provided with a slot in which the bracket moves, and the reciprocating means moves the bracket.

* * * * *